United States Patent [19]

Sakura et al.

[11] Patent Number: 4,814,665

[45] Date of Patent: Mar. 21, 1989

[54] CENTER ELECTRODE STRUCTURE FOR SPARK PLUG

[75] Inventors: Akio Sakura; Mitsutaka Yoshida; Junichi Kagawa, all of Nagoya, Japan

[73] Assignee: NGK Spark Plug Co. Ltd., Nagoya, Japan

[21] Appl. No.: 96,042

[22] Filed: Sep. 11, 1987

[30] Foreign Application Priority Data

Sep. 12, 1986 [JP] Japan ..... 61-214014

[51] Int. Cl.[4] ..... H01T 13/20

[52] U.S. Cl. ..... 313/141; 313/145; 313/11.5

[58] Field of Search ..... 313/135, 136, 141, 145, 313/11.5

[56] References Cited

U.S. PATENT DOCUMENTS 3,119,944 1/1964 Lentz et al. ..... 313/141

4,314,392 2/1982 Waite ..... 313/141 X 4,575,343 3/1986 Kin et al. ..... 313/141 X

*Primary Examiner*—David K. Moore

*Assistant Examiner*—K. Wieder

*Attorney, Agent, or Firm*—Cooper & Dunham

[57] ABSTRACT

In a center electrode structure for spark plug including a tubular insulator, the inner side of which has a stepped shoulder to provide a diameter-reduced bore therein; a center electrode having a flange, and concentrically placed into the insulator with the flange engaging against the shoulder, and with one end being axially through the bore so as to be exposed to outside of the insulator; the center electrode having a highly heat conductive core of copper or copper-based alloy which is encased into an enclosure made of oxidation and heat resistant nickel-based alloy; and the core providing its overall outer surface with a thin oxidation layer, so that the core is clad with the enclosure through the oxidation layer by means of extrusion.

2 Claims, 2 Drawing Sheets

CENTER ELECTRODE STRUCTURE FOR SPARK PLUG

BACKGROUND OF THE INVENTION

1. Field of the Invention

This invention relates to a center electrode structure having an oxidation, heat resistant enclosure and heat conductive core member encased into the enclosure, and paticularly concerned to an improved center electrode structure so as to advantageously absorb thermal deformation due to high ambient temperature.

2. Description of the Prior Art

In a spark plug for an internal combustion engine, a center electrode exposes one end to a combustion chamber, so that it is subjected to a large quantity of heat and oxidation for an extended time period.

To cope with the heat and oxidation, a center electrode is made from a copper-based core and a platinium or nickel-based enclosure clad by means of extrusion to ensure good heat conduction, oxidation and heat resistivity simultaneously. By way of illustration, the enclosure is previously purged and annealed for one hour at 650 degrees centigrade, at the same time, the core is also purged and pickled. The core thus pickled, is pressure fit into the enclosure in the air-tight relationship, and placed under the inert gaseous atmosphere at the temperature of 930 degrees centigrade for 1.5 hours so as to allow diffusion between the core and the enclosure.

The center electrode thus comprised, however, renders the platinium-based enclosure expensive, in addition to it, the center electrode deforms due to thermal expansional difference by a thermal stress, thus leading to deviating from a normal discharge gap so as to be short of good and stable sparking action.

Therefore, it is an object of this invention to provide a center electrode structure which is capable of absorbing a thermal expansional difference between a core and enclosure members protecting against inadvertent deformation to ensure good and stable sparking action continuously with relatively low cost.

According to the invention, in a center electrode structure for spark plug comprising a tublar insulator, the inner side of which has a stepped shoulder to provide a diameter-reduced bore therein; a center electrode having a flange, and concentrically placed into the insulator with the flange engaging the shoulder, and with one end being axially through the bore to be exposed to outside of the insulator; the center electrode having an electrically conductive core member of copper or copper-based alloy which is encased into an enclosure made of an oxidation and heat resistant nickel-based alloy; and the core member providing the overall outer surface with a thin oxidation layer, so that the core member is clad with the enclosure through the thin oxidation layer by means of extrusion.

DESCRIPTION OF THE PREFERRED EMBODIMENT

In reference with the accompanied drawings, a preferred embodiment of this invention is described hereinafter.

Figure 1:
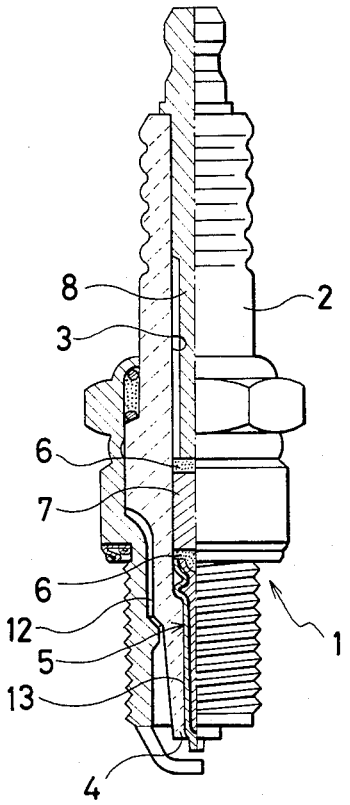
FIG. 1 is a longitudinal cross sectional view of a spark plug of the present invention.
Figure 2:
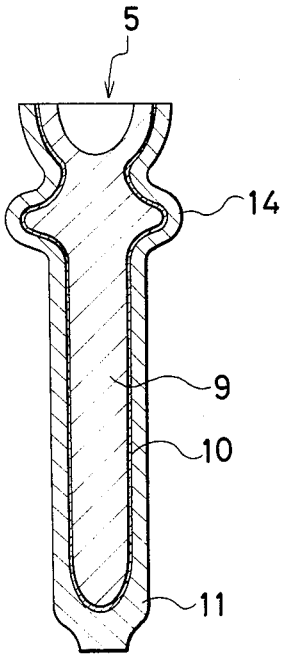
FIG. 2 is a longitudinal cross sectional view of a center electrode, but enlarged greater than that of FIG. 1.

As shown in FIG. 1, numeral 1 designates a whole structure of a spark plug according to this invention. An tubular insulator 2, which is made from ceramic such as alumina or the like, has a stepped shoulder 12 to provide a diameter-reduced top bore 13 which is in communication with an axial bore 3. Into the insulator 2, a center electrode 5 is placed which has a flange 14 engaging with the shoulder 12. The lower end of the center electrode 5 is protracted from the end of the insulator 2 to be exposed to the outside such as a combustion chamber when mounted on an internal combustion engine. At the upper end of the center electrode 5, a electrically conductive glass sealant 6, an electrical resistor 7 and a terminal 8 are thermally sealed at the temperature of 800–1100 degrees centigrade. This is well-known for those skilled in the art.

Now, the center electrode 5 has a somewhat elongated core member 9, the overall outer surface of which is covered with an oxidation layer 10, and having further an enclosure 11 to act as a clad member. The core member 9 is made from copper or copper-based alloy to impart a highly heat conductive property, while the enclosure 11 being from a heat and oxidation resistant nickel-based alloy. The copper-based alloy is preferably mixed with 0.01–1.0 weight percent of one or more than two elements selected among aluminum, silicon, manganese, titanium, ziruconium or chrome. Meantime, the nickel-based alloy preferably has additional elements of silicon, chrome, manganese, aluminum, or ferrous metal.

Figure 3:
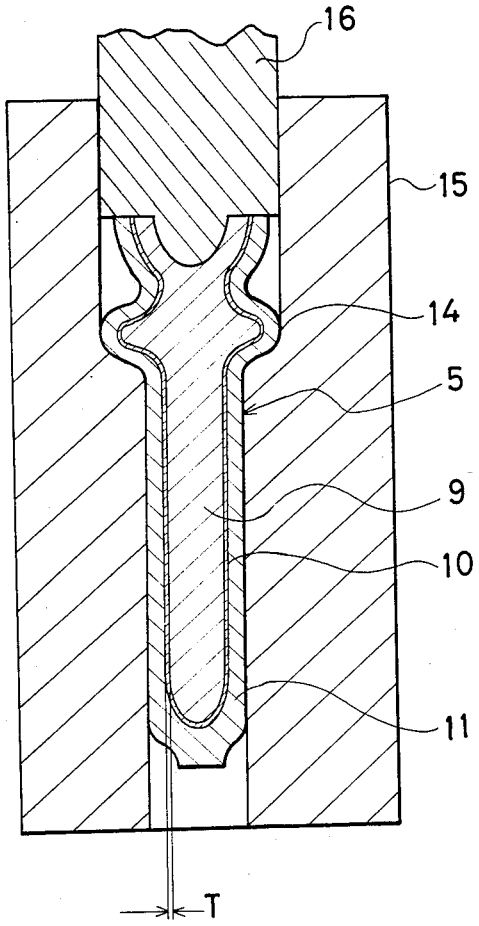
FIG. 3 is a longitudinal cross sectional view of a center electrode with an extruding machine.

The center electrode 5 is manufactured in a method as follows:

As a first step, the core member 9 is previously purged and annealed under the atmosphere of 300 degrees centigrade for more than one hour, or otherwise the core member 9 is dipped into an admixture liquid of sodium hypochlorite (NaClO 100 g) and sodium hydrate (NaOH 100 g) which are solved by water of one liter, and kept at 70–100 degrees centigrade. By these treatments, the oxidation layer 10 of predetermined thickness appears at the overall surface. Then, the core member 9 is integrally encased into the enclosure 11 through the oxidation layer 10, and therafter the core 9 together with the enclosure 11 is, as seen in FIG. 3, integrally extruded by a machine combining an outer die 15 and a rod 16 to form the center electrode 5, determining the thickness (T) of the oxidation layer 10 as 1.0 microns.

It is noted that the thickness of oxidation layer 10 may be within the range from 1.0 microns to 10 microns, from the reason that a very thin layer allows the diffusion between nickel-based alloy and copper-based alloy through the layer so as to render difficult to specify its thickness dimension, while a layer exceeding to 10 microns in thickness, decreases thermal conduction from an enclosure to a core so as to reduce heat resistivity as a whole.

With the structure thus far described, the cener electrode 5 is exposed to the combustion chamber which is under high atomospheric temperature and high corrosive environment at the time of running the engine. In this instance, the core 9 and the enclosure 11 each indivisually deform due to the difference of thermal expansional quantity.

However, the expansional difference between the core 9 and the enclosure 11 is sufficiently absorbed by the oxidation layer 10 so as to avoid the center electrode 5 against unfavorable deformation, thus leading to assuring a required length of spark gap continuously, sustaining a long period of its servicing life.

Below is a list to show how long period a center electrode sustains from an adverse environment in a combustion chamber depending upon adding degree of other elements to the copper-based core, and the thickness of the oxidation layer. In this list, heat resistant nickel-based alloys with addition of 1–2 weight percent of silicon, chrome or the like, are employed as test piece enclosures according to this invention, and at the same time, employing copper or copper-based alloy as test piece cores which build up oxidation layers of different thickness.

In the meantime, an oxidation-free copper (as referred to as OFC) is employed as a prior art counterpart. As seen from the list, the cores of copper-based alloy with oxidation layers of 3 microns in thickness, normally work even at the running time period extending to 1000 hours without abnormal deformation.

| test piece | Cu—alloy | layer thickness | hours taken to deform |
|---|---|---|---|
| prior art | OFC | null | 400 |
| invention 1 | Cu | 1 micron | 700 |
| invention 2 | Cu—0.2Al | 1 micron | 1000 |
| invention 3 | Cu—0.2Al | 3 microns | 1000 still normal |
| invention 4 | Cu—0.2Ti | 3 microns | 1000 still normal |
| invention 5 | Cu—0.2Si | 3 microns | 1000 still normal |
| invention 6 | Cu—0.2Mn | 3 microns | 1000 still normal |
| invention 7 | Cu—0.2Cr | 3 microns | 1000 still normal |
| invention 8 | Cu—0.2Zr | 3 microns | 1000 still normal |
| invention 9 | Cu—0.2Si—0.1Mg | 3 microns | 1000 still normal |

As apparently understood from the foregoing description, the center electrode 5 is avoided from being abnormally deformed in a degree to change the spark gap, due to the fact that the thermal expansional difference between the core 9 and the enclosure 11, is preferably absorbed by the oxidation layer 10, thus conducive to the extended period of servicing life.

It should be further appreciated that an oxidation layer is of oxidation and heat resistant property, advantageously eliminating the need of selecting a material with this property taking into consideration.

The present invention is further described in the claims which follows:

What is claimed is:

1. In a center electrode structure for a spark plug including a tubular insulator, the inside of which has a stepped shoulder to provide a diameter-reduced bore therein;

a center electrode having a flange and concentrically placed within said insulator with said flange engaged against said shoulder, with one end of said center electrode passing through said bore to be outside of said insulator;

said center electrode comprising;

a heat conductive core member made of copper or copper-based alloy;

an enclosure member made of an oxidation heat-resistant nickel-based alloy, open at one end and closed at the other end;

the improvement wherein the entire outer surface of said core member is provided with a thin coating of an oxidation layer, so that said core member extends through said open end and is fitted therein to be tightly engaged with the inside of said enclosure member whereby said layer absorbs deformation due to a thermal expansional difference between said core and enclosure members.

2. In a center electrode structure in accordance with claim 1 wherein said oxidation layer has a thickness in the range from 1.0 micron to 10 microns.

* * * * *